US008123151B2

(12) United States Patent
Cheng

(10) Patent No.: US 8,123,151 B2
(45) Date of Patent: Feb. 28, 2012

(54) SPRINKLING GUN STRUCTURE

(75) Inventor: Chi Han Cheng, Changhua Hsien (TW)

(73) Assignee: Yuan Mei Corp., Changhua County (TW)

( * ) Notice: Subject to any disclaimer, the term of this patent is extended or adjusted under 35 U.S.C. 154(b) by 0 days.

(21) Appl. No.: 12/081,119

(22) Filed: Apr. 10, 2008

(65) Prior Publication Data

US 2011/0180636 A1 Jul. 28, 2011

(51) Int. Cl.

| | |
|---|---|
| ***B05B 7/02*** | (2006.01) |
| ***B05B 1/30*** | (2006.01) |
| ***B05B 15/08*** | (2006.01) |
| ***B05B 1/00*** | (2006.01) |

(52) U.S. Cl. ..... 239/586; 239/525; 239/577; 239/581.1; 239/583; 239/587.6; 239/600

(58) Field of Classification Search ..... 239/394, 239/525, 532, 581.1, 583, 586, 587.4, 587.6, 239/590, 600

See application file for complete search history.

(56) References Cited

U.S. PATENT DOCUMENTS

| | | | | |
|---|---|---|---|---|
| 6,073,863 | A * | 6/2000 | Wang | 239/525 |
| 6,367,716 | B1 * | 4/2002 | Wang | 239/526 |
| 6,585,174 | B1 * | 7/2003 | Huang | 239/581.1 |
| 7,328,860 | B1 * | 2/2008 | Chen et al. | 239/581.1 |
| 2003/0111556 | A1 * | 6/2003 | Kuo | 239/530 |

* cited by examiner

*Primary Examiner* — Len Tran
*Assistant Examiner* — Ryan Reis
(74) *Attorney, Agent, or Firm* — Chi IP Law Firm

(57) ABSTRACT

A sprinkling gun structure including a main body having two ends respectively formed with a water inlet and an adaptation hole. An assembling tunnel is transversely formed through the main body between the water inlet and the adaptation hole to communicate therewith. The sprinkling gun further includes an adjustment member, a controlling member having a water-checking section and a water intake, and a water-guiding member having a watertight sleeve fitted on bottom end of the water-guiding member. The controlling member is fitted in the assembling tunnel and rotationally drivable by the adjustment member. When driven, the water-checking section of the controlling member is rotated to cooperate with the watertight sleeve so as to shut off/turn on and micro-adjust the water flow.

18 Claims, 9 Drawing Sheets

SPRINKLING GUN STRUCTURE

BACKGROUND OF THE INVENTION

The present invention is related to a sprinkling gun including an adjustment member, a controlling member having a water-checking section and a water intake, and a water-guiding member having a watertight sleeve. The controlling member is drivable by the adjustment member to cooperate with the water-guiding member in shutting off/turning on the water flow. The adjustment member can be operated with less strength to micro-adjust the amount of the water flow. In addition, the components of the sprinkling gun can be easily and quickly assembled.

A conventional gardening-used sprinkling gun is generally equipped with a lever. In use, a user holds both the handle and the lever of the sprinkling gun and exert a pressing force onto the lever to sprinkle water. The amount of the sprinkled water is controlled by the pressing force applied to lever. After a long period of holding, the user's hand often suffers fatigue and pain. Under such circumstance, it will become difficult for the user to stably hold the handle with a true strength. As a result, the amount of the sprinkled water will randomly vary out of control. Therefore, it is inconvenient to use such sprinkling gun.

SUMMARY OF THE INVENTION

It is therefore a primary object of the present invention to provide a sprinkling gun of which the components can be easily and quickly assembled.

It is a further object of the present invention to provide the above sprinkling gun including an adjustment member, a controlling member having a water-checking section and a water intake, and a water-guiding member having a watertight sleeve. The controlling member is drivable by the adjustment member to cooperate with the water-guiding member in shutting off/turning on the water flow and micro-adjusting the amount of the water flow.

It is still a further object of the present invention to provide the above sprinkling gun in which the watertight sleeve is fitted on a bottom end of the water-guiding member and has a first water-sealing section and a second water-sealing section. The first water-sealing section tightly abuts against the water-checking section of the controlling member, while the second water-sealing section tightly abuts against an inner wall face of an adaptation hole of the main body of the sprinkling gun. Therefore, in a shutoff state, the water is double-sealed to achieve a true leakproof effect. In addition, the frictional area between the controlling member and the watertight sleeve is reduced so that the adjustment member can be easily operated with less strength to drive the controlling member for shutting off/turning on the water flow and micro-adjusting the amount of the water flow.

The present invention can be best understood through the following description and accompanying drawings wherein:

DETAILED DESCRIPTION OF THE PREFERRED EMBODIMENTS

Figure 1:
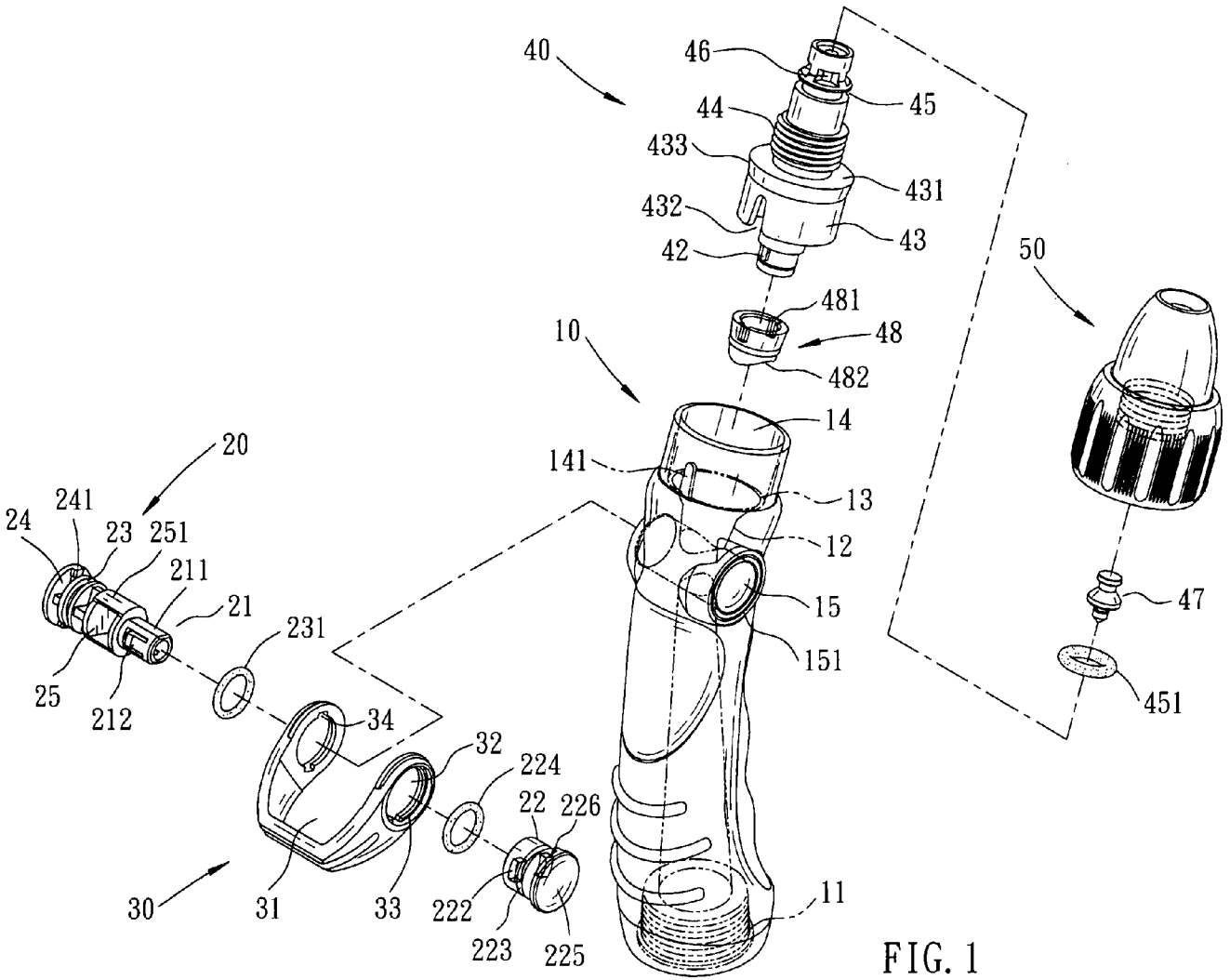
FIG. 1 is a perspective exploded view of a first embodiment of the present invention.
Figure 2:
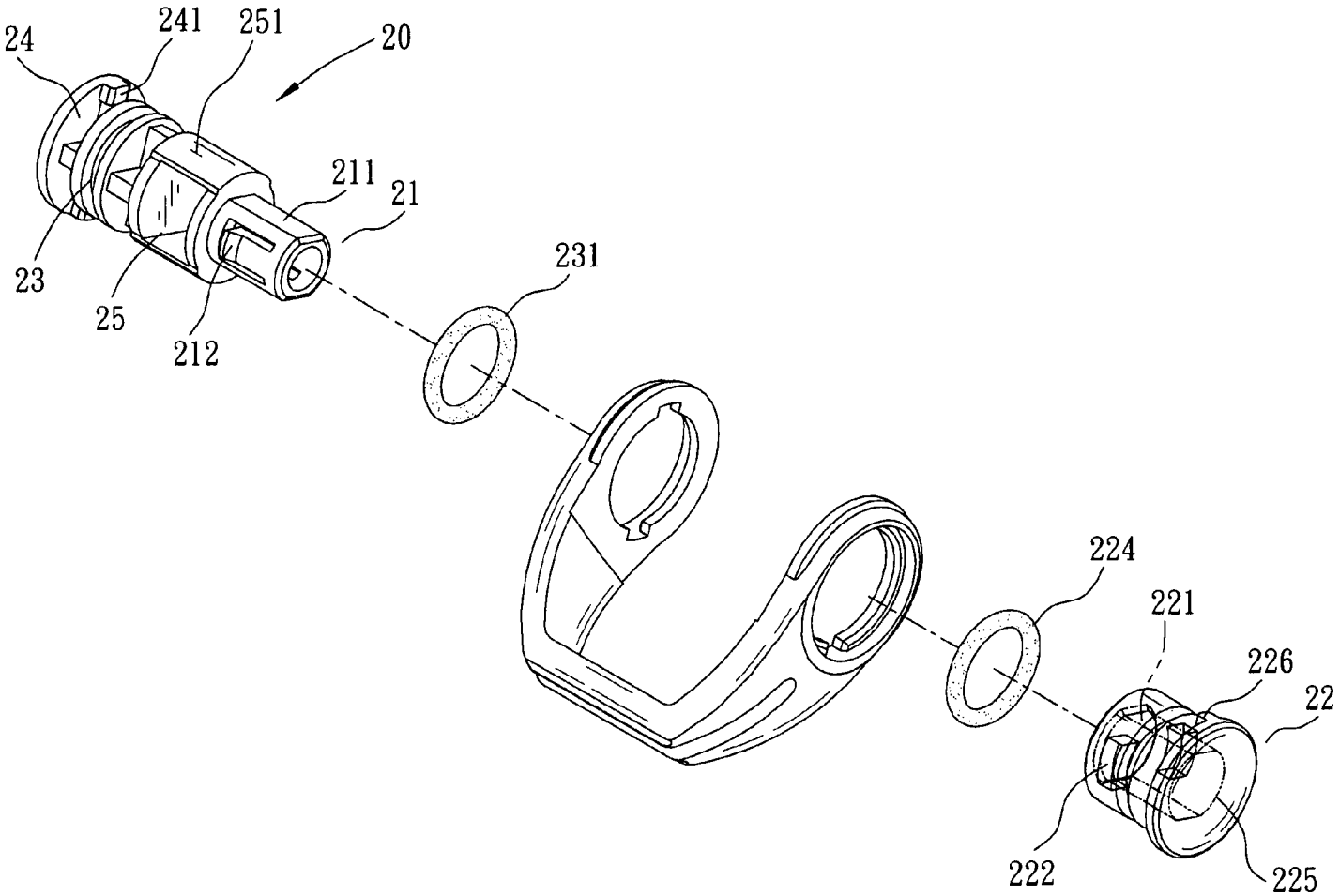
FIG. 2 is a perspective exploded view of the controlling member and adjustment member of the first embodiment of the present invention.
Figure 3:
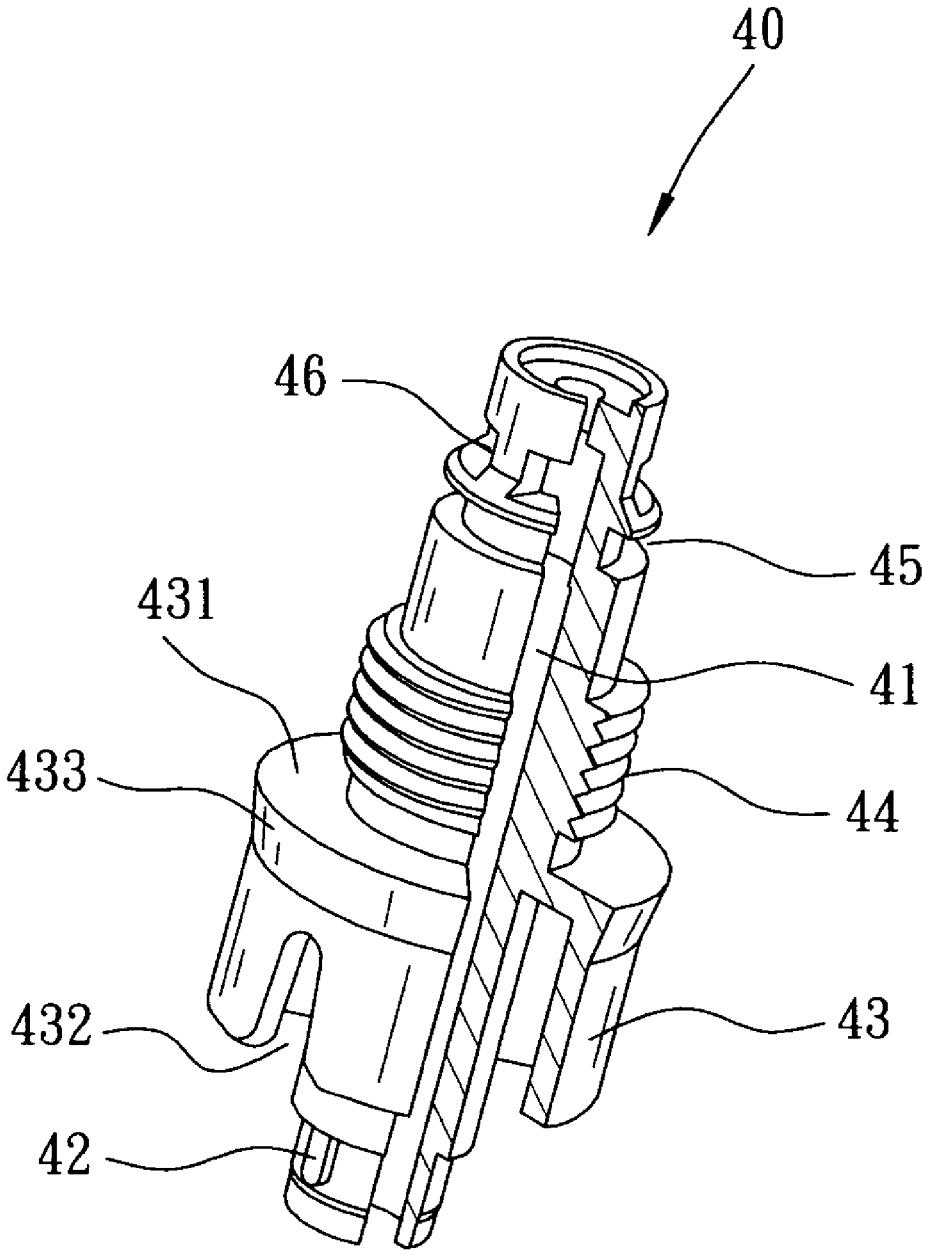
FIG. 3 is a perspective sectional view of the water-guiding member of the first embodiment of the present invention.
Figure 4:
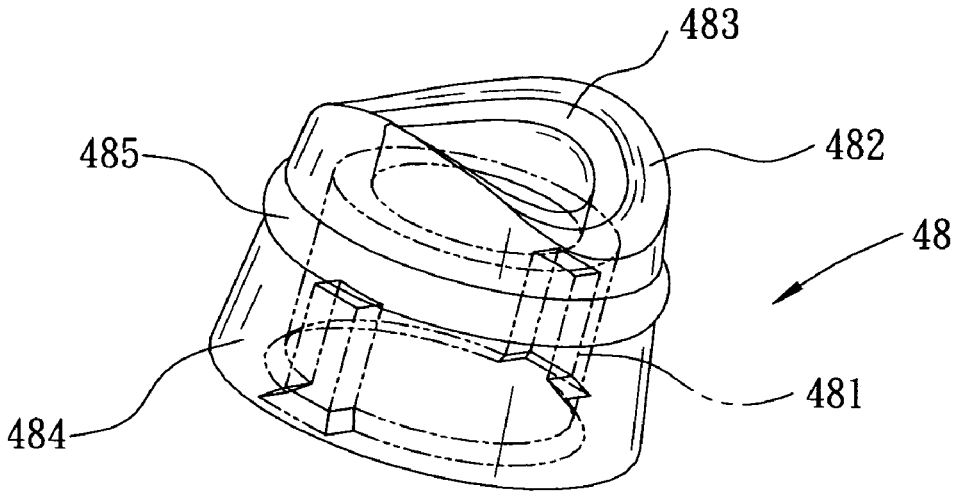
FIG. 4 is a perspective enlarged view of the watertight sleeve of the first embodiment of the present invention.
Figure 5:
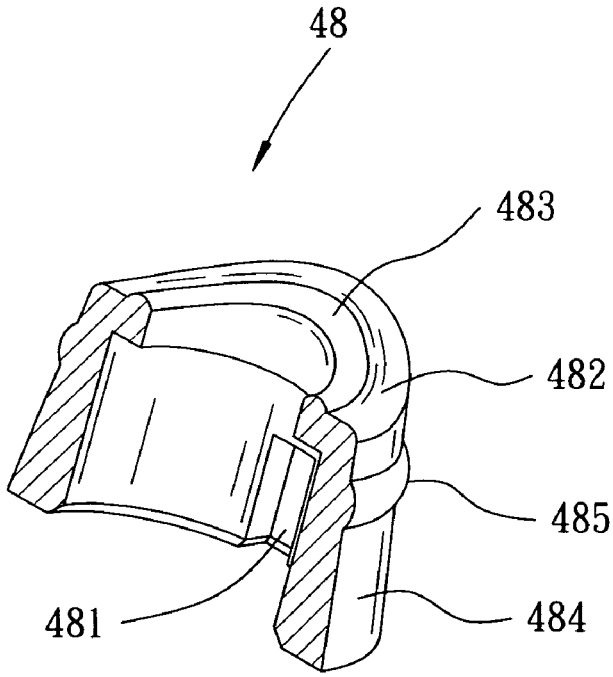
FIG. 5 is a perspective sectional view of the watertight sleeve of the first embodiment of the present invention.

Please refer to FIG. 1 as well as FIGS. 2 to 5. The sprinkling gun structure of the present invention includes a main body 10, a controlling member 20, an adjustment member 30, a water-guiding member 40 and a sprinkling head 50 having an inner thread section 51. One end of the main body 10 is formed with a water inlet 11 having an inner thread section. The other end of the main body 10 is formed with a trumpet-shaped adaptation hole 12 opposite to the water inlet 11. An annular stopper shoulder section 13 upward extends from the adaptation hole 12. A fitting section 14 with larger diameter upward extends from the shoulder section 13. Several longitudinal ribs 141 are formed on inner wall face of the fitting section 14. An assembling tunnel 15 is transversely formed through the main body 10 between the water inlet 11 and the adaptation hole 12 to communicate therewith. Two stopper sinks 151 with larger diameter are respectively formed at two ends of the assembling tunnel 15. One end of the controlling member 20 is formed with a fitting section 21 with smaller diameter, to which a sealing cap 22 is adapted. Another end of the controlling member 20 is formed with an annular groove 23 in which a watertight ring 231 is inlaid. In addition, the other end of the controlling member 20 has a stopper section 24 with larger diameter. Two projecting blocks 241 are respectively formed on two sides of the stopper section 24. The other end of the controlling member 20 serves as another fitting section. A water intake 25 is formed at a middle portion of the controlling member 20. Two least one arced plate-like water-checking section 251 are symmetrically disposed on two sides of the water intake 25 along a circumference thereof. The fitting section 21 is a tubular section formed with two symmetrical adaptation planes 211 and two symmetrical hook-shaped resilient tongues 212. Two adaptation planes 221 and two windows 222 are symmetrically disposed on an inner wall of the sealing cap 22 and respectively adapted to the adaptation planes 211 and resilient tongues 212. An annular groove 223 is formed on outer wall face of the sealing cap 22 and a watertight ring 224 is inlaid in the annular groove 223. A stopper section 225 with larger diameter is formed at one end of the sealing cap 22. Two projecting blocks 226 are respectively formed on two sides of the stopper section 225. The adjustment member 30 is a U-shaped member defining a holding space 31 adapted to the main body 10. The free ends of two arms of the adjustment member 30 are respectively formed with two stop seats 33 each defining a stepped fitting hole 32. Two notches 34 are symmetrically formed on two sides of each stop seat 33. The water-guiding member 40 is formed with a central water conduit 41. Two engaging ribs 42 are symmetrically formed on outer wall face of lower section of the water-guiding member 40. A substantially U-shaped bulged fitted section 43 is formed on middle section of the water-guiding member 40 to define a stepped locating seat 431. Two V-shaped engaging notches 432 are symmetrically formed on outer circumference of the fitted section 43. A downward tapered section 433 is formed on upper portion of the fitted section 43. An outer thread section 44 with smaller diameter is formed above the locating seat 431 for screwing with the sprinkling head 50. An annular groove 45 is formed above the outer thread section 44, in which a watertight ring 451 is inlaid. At least one water outlet 46 is formed on a circumference of upper end of the water-guiding member 40 to communicate with the water conduit 41. A pushpin-like water-figuring head 47 is assembled with the top of the water-guiding member 40. In addition, a soft watertight sleeve 48 is fitted with the water-guiding member 40. The soft watertight sleeve 48 is formed with a water passage. Recesses 481 are symmetrically formed on inner face of the soft watertight sleeve 48. The engaging ribs 42 of the water-guiding member 40 are chucked in the recesses 481 to fit the soft watertight sleeve 48 on the water-guiding member 40. One end of the soft watertight sleeve 48 is formed with a concaved attaching face 482 adapted to the water-checking section 251. A first water-sealing section 483 integrally swells from the concaved attaching face 482. In addition, the soft watertight sleeve 48 has a downward tapered section 484 extending from the concaved attaching face 482. A second water-sealing section 485 is integrally positioned on the tapered section 484.

Figure 6:
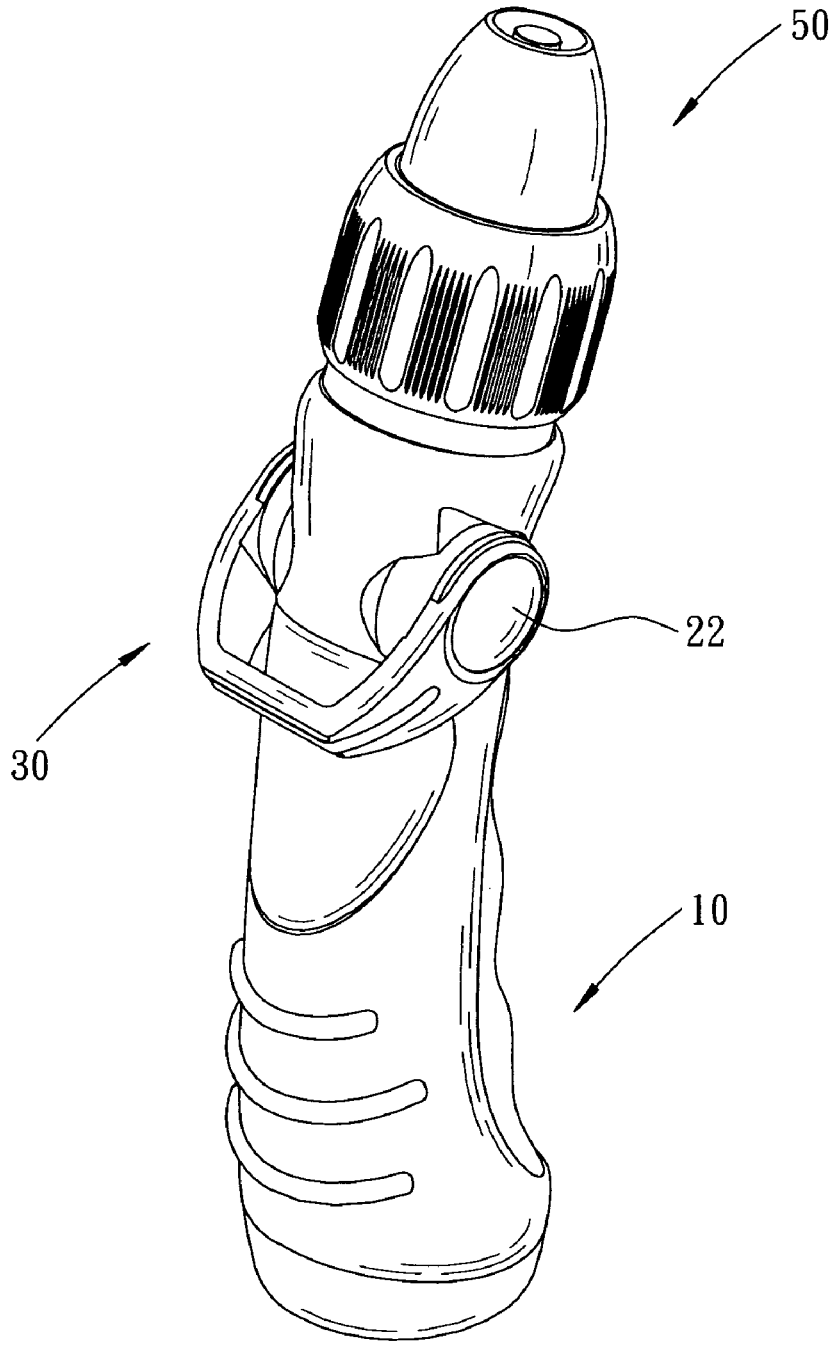
FIG. 6 is a perspective assembled view of the first embodiment of the present invention.
Figure 7:
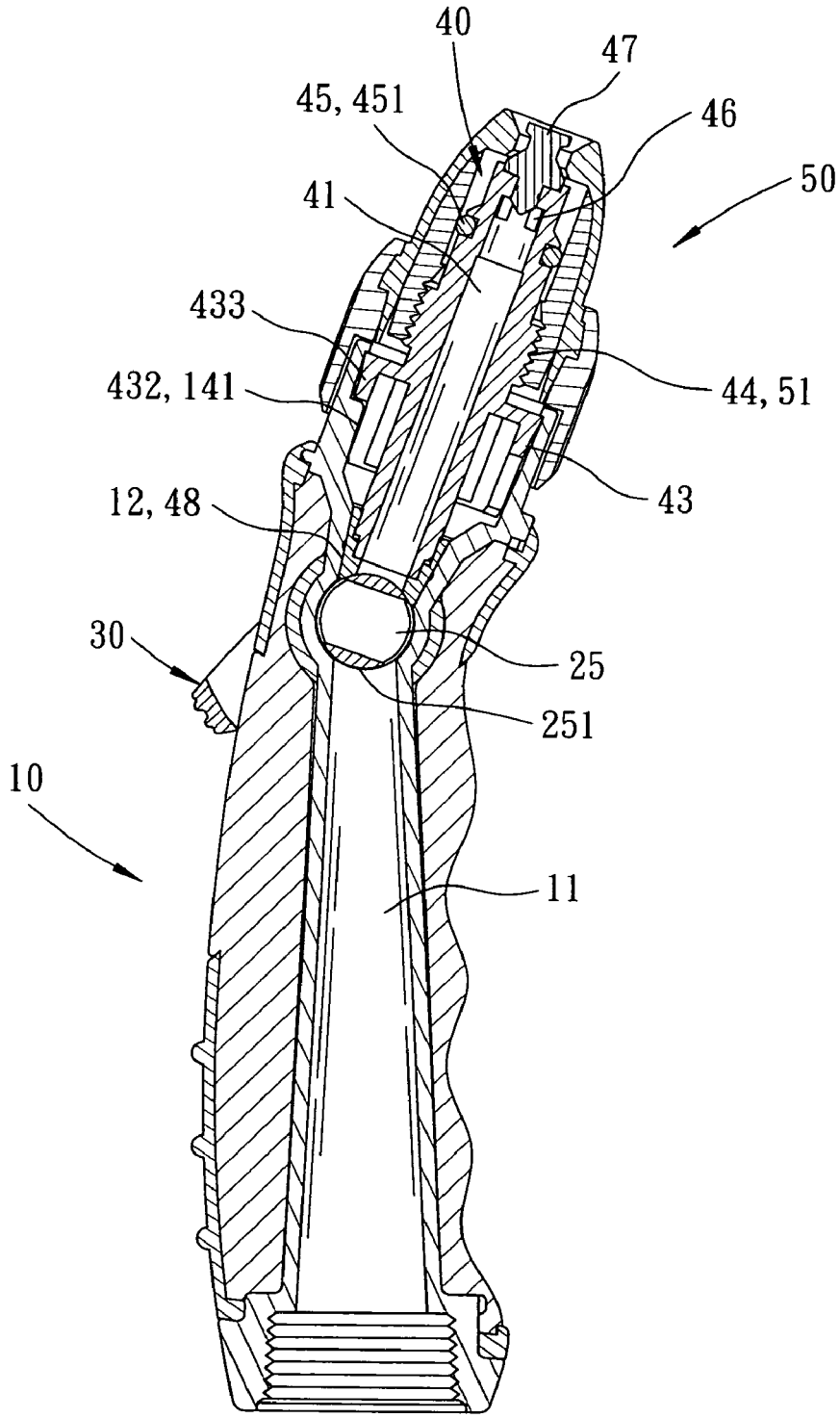
FIG. 7 is a longitudinal sectional assembled view of the first embodiment of the present invention in a shutoff state.

When assembled, as shown in FIGS. 6 and 7, one side of the main body 10 is fitted into the holding space 31 of the adjustment member 30 with the fitting holes 32 right positioned on two sides of the assembling tunnel 15. The controlling member 20 is rotatably fitted through one fitting hole 32 into the assembling tunnel 15 with the stopper section 24 abutting against the stop seat 33. At this time, the projecting blocks 241 are chucked in the notches 34 and the water-checking sections 251 and the water intake 25 are right positioned between the water inlet 11 and the adaptation hole 12. Then the sealing cap 22 is rotatably fitted through the other fitting hole 32 into the assembling tunnel 15 and fitted with the fitting section 21. At this time, the resilient tongues 212 are resiliently trapped in the windows 222 and the adaptation faces 211 and the adaptation faces 221 attach to each other to restrict each other. The stopper section 225 abuts against the stop seat 33 and the projecting blocks 226 are chucked in the notches 34. The watertight ring 231 of the controlling member 20 and the watertight ring 224 of the sealing cap 22 watertight abut against inner wall faces of two ends of the assembling tunnel 15 so as to avoid leakage. Then the water-guiding member 40 is fitted into the fitting section 14 with the ribs 141 chucked and located in the engaging notches 432 of the fitted section 43. At this time, the water-guiding member 40 just abuts against the stopper shoulder section 13 and is retained. Also, the tapered section 433 is tightly fitted in the fitting section 14. In addition, the tapered section 484 and the second water-sealing section 485 of the watertight sleeve 48 are tightly fitted in the adaptation hole 12. The concaved attaching face 482 is adapted to the water-checking section 251 so that the first water-sealing section 483 just tightly attaches to the surface of the water-checking section 251 to shut off the water flow. In addition, a punching force is applied to the end face of the fitting section 14 to rivet the fitting section 14 with the locating seat 431 of the fitted section 43. Under such circumstance, the water-guiding member 40 is fixedly restricted within the fitting section 14. Then the inner thread section 51 of the sprinkling head 50 is screwed on the outer thread section 44 to form the sprinkling gun.

Figure 8:
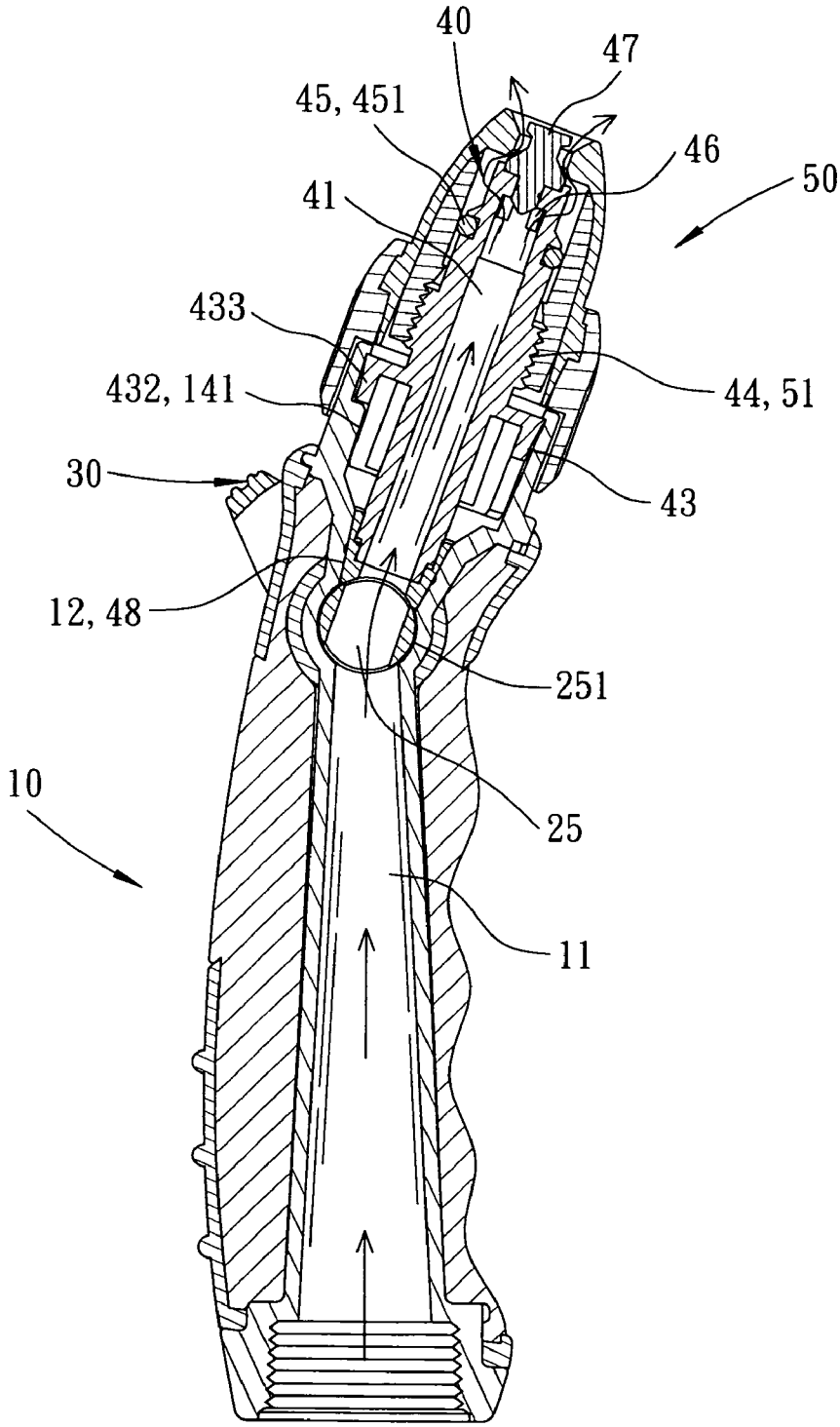
FIG. 8 is a longitudinal sectional assembled view of the first embodiment of the present invention in a turn-on state according to FIG. 7.

In use, as shown in FIG. 8, the projecting blocks 241, 226 of the controlling member 20 and the sealing cap 22 are respectively chucked in the notches 34 of the adjustment member 30 so that simply by means of rotating the adjustment member 30, the water-checking sections 251 of the controlling member 20 are synchronously driven to rotate about an axis of the assembling tunnel 15. At this time, the first water-sealing section 483 of the attaching face 482 of the watertight sleeve 48 tightly abuts against the water-checking sections 251 and watertight rings 231, 224 of the controlling member 20 tightly abut against the inner circumference of the assembling tunnel 15 so as to define a closed water incoming space. Therefore, not only a true leakproof effect is achieved, but also the frictional area between the controlling member 20 and the wall of the assembling tunnel 15 and the watertight sleeve 48 is reduced. Accordingly, it is more strength-saving to rotate the adjustment member 30. In addition, when the water-checking sections 251 are rotated along with the adjustment member 30 to disengage from the first water-sealing section 483 and the water intakes 25 respectively communicate with the water inlet 11 and the water conduit 41, the water flow can flow into the water inlet 11 through the water intakes 25 and the water conduit 41 out of the water outlets 46. The water flow is stopped by the watertight ring 451 to flow along the inner wall face of the sprinkling head 50 and sprinkle out from the water-figuring head 47. By means of turning the adjustment member 30, the controlling member 20 is driven to gradually enlarge the intake angle of the water intake 25 so as to control the amount of the water flow. Therefore, the amount of the sprinkling water of the sprinkling gun can be easily micro-controlled by means of the adjustment member 30. Also, the first and second water-sealing sections 483, 485 of the watertight sleeve 48 respectively tightly abut against the water-checking sections 251 and the inner wall face of the adaptation hole 12. Therefore, in a shutoff state, the water is double-sealed. In a turn-on state, the second water-sealing section 485 still tightly abuts against the inner wall face of the adaptation hole 12, whereby the water flow collectively flows through the water intakes 25 into the water conduit 41 to sprinkle out from the water-figuring head 47.

Figure 9:
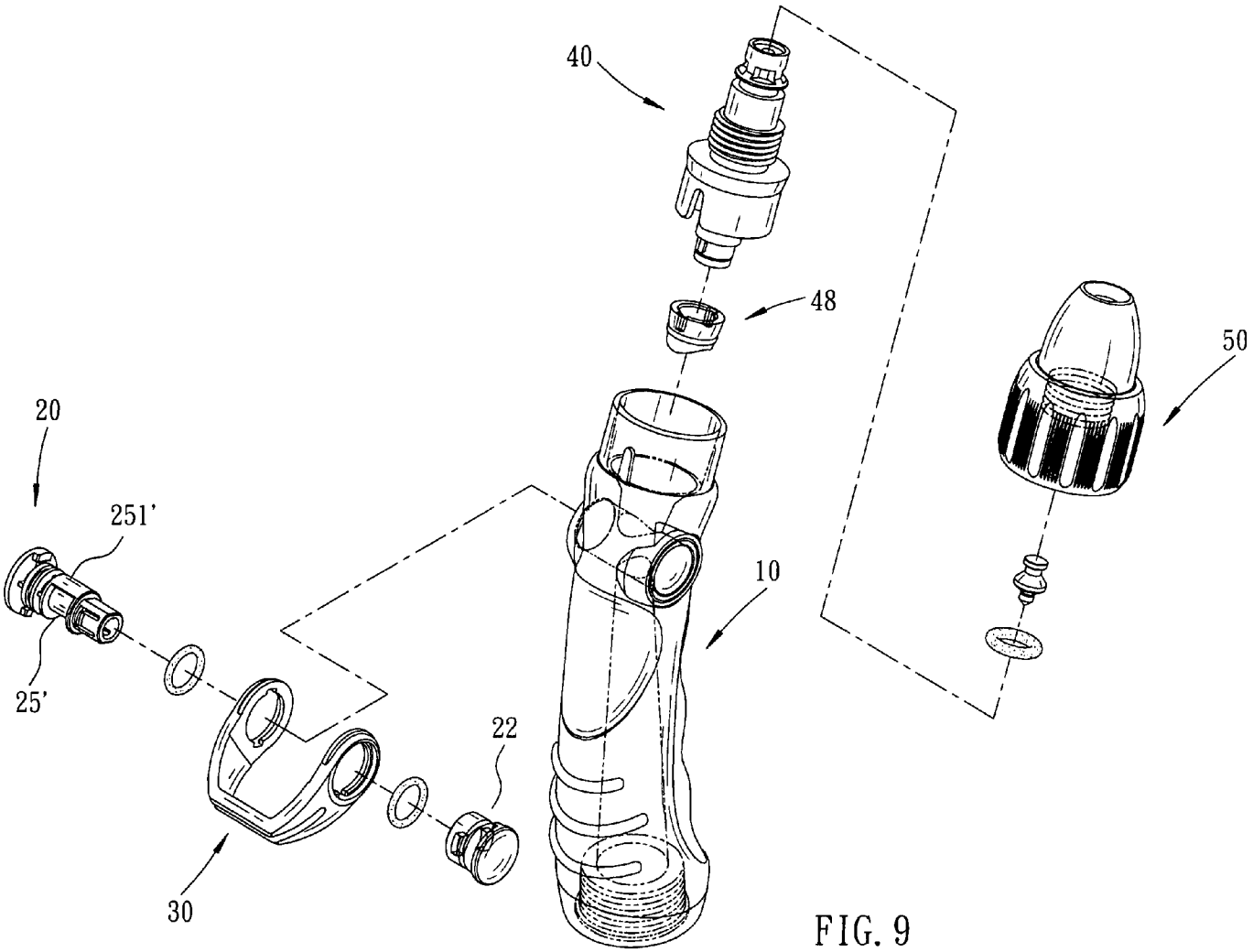
FIG. 9 is a perspective exploded view of a second embodiment of the present invention.
Figure 10:
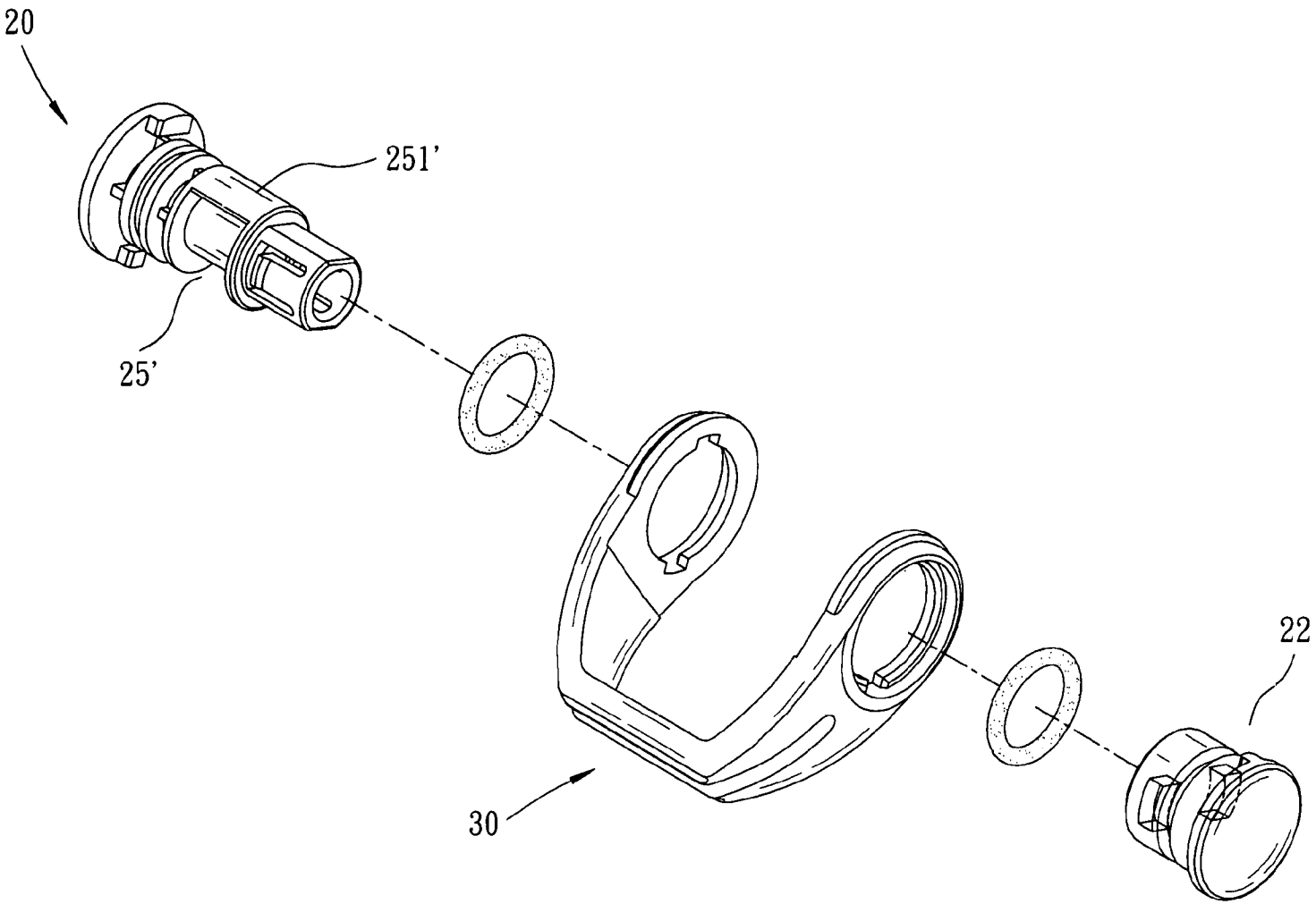
FIG. 10 is a perspective exploded view of the controlling member and adjustment member of the second embodiment of the present invention.

FIGS. 9 and 10 show a second embodiment of the present invention, in which there are only one water intake 25' and one water-checking section 251'. The water-checking section 251' is a semicircular section, while the water intake 25' is a semicircular sink.

The above embodiments are only used to illustrate the present invention, not intended to limit the scope thereof. Many modifications of the above embodiments can be made without departing from the spirit of the present invention.

What is claimed is:

1. A sprinkling gun structure comprising:

a main body, one end of the main body being formed with a water inlet, another end of the main body being formed with an adaptation hole having a fitting section, an assembling tunnel being transversely formed through the main body between the water inlet and the adaptation hole to communicate therewith, a controlling member having a water intake and at least one water-checking section being rotatably fitted in the assembling tunnel, the controlling member being rotationally drivingly engaged with an adjustment member, wherein one end of the controlling member is formed with a fitting section having smaller diameter, a sealing cap being fitted with the fitting section, the fitting section being a tubular section formed with two symmetrical adaptation planes and two symmetrical hook-shaped resilient tongues, two adaptation planes and two windows being symmetrically disposed on an inner wall of the sealing cap and respectively adapted to the adaptation planes and resilient tongues of the fitting section, the end of the controlling member being formed with an annular groove in which a watertight ring is inlaid, the other end of the controlling member having a stopper section with larger diameter, projecting blocks being respectively formed on two sides of the stopper section, whereby the other end of the controlling member serves as another fitting section, the adjustment member being a U-shaped member defining a holding space adapted to the main body, free ends of two arms of the adjustment member being respectively formed with two stop seats each defining a stepped fitting hole, two notches being symmetrically formed on two sides of each stop seat, the projecting blocks of the stopper section and projecting blocks of the sealing cap being chucked and located in the notches, whereby by means of rotating the adjustment member by different angles, the water intake and the water-checking section are displaced to different extents so as to control the amount of the sprinkling water or turn off/on the water flow, the sprinkling gun structure further comprising a water-guiding member having a fitted section and fixedly fitted in the fitting section of the main body, the water-guiding member being formed with a water conduit, a soft watertight sleeve being fitted with a lower section of the water-guiding member, a concaved attaching face being formed at lower end of the watertight sleeve, a water-sealing section integrally swelling from the concaved attaching face for tightly abutting against the water-checking section of the controlling member to achieve a shutoff state, the soft watertight sleeve having a downward tapered section extending from the concaved attaching face for tightly abutting against inner wall face of the adaptation hole, when the water-checking section of the controlling member is rotated along with the adjustment member to disengage from the attaching face of the watertight sleeve, the water intake communicating with the water conduit and the water inlet to achieve a turn-on state, whereby the water can flow through the water inlet and the water intake into the water conduit and sprinkle out.

2. The sprinkling gun structure as claimed in claim 1, wherein the fitting section of the main body and the fitted section of the water-guiding member have larger diameter, whereby an annular stopper shoulder section is defined between the adaptation hole and the fitting section, several ribs being formed on inner wall face of the fitting section and several engaging notches being formed on outer circumference of the fitted section, the ribs being fixedly chucked and located in the engaging notches.

3. The sprinkling gun structure as claimed in claim 1, wherein engaging ribs are formed on outer face of lower section of the water-guiding member and recesses are formed on inner face of the soft watertight sleeve, the engaging ribs being chucked and located in the recesses.

4. The sprinkling gun structure as claimed in claim 1, wherein a water-sealing section is positioned on the tapered section of the watertight sleeve for tightly abutting against inner wall face of the adaptation hole.

5. The sprinkling gun structure as claimed in claim 1, wherein a first water-sealing section swells from the concaved attaching face of the watertight sleeve for tightly abutting against the water-checking section of the controlling member and a second water-sealing section is positioned on the tapered section of the watertight sleeve for tightly abutting against inner wall face of the adaptation hole of the main body.

6. The sprinkling gun structure as claimed in claim 1, wherein the water intake is formed at a middle portion of the controlling member, the water-checking sections being an arced plate-like section symmetrically disposed on two sides of the water intake along a circumference thereof.

7. The sprinkling gun structure as claimed in claim 1, wherein the controlling member has a semicircular water intake and a semicircular water-checking section.

8. The sprinkling gun structure as claimed in claim 1, wherein a downward tapered section is formed on upper portion of the fitted section of the water-guiding member for tightly abutting against inner wall face of the fitting section of the main body, a punching force being applied to the end face of the fitting section to rivet the fitting section with the fitted section, whereby the water-guiding member is fixedly restricted within the fitting section.

9. The sprinkling gun structure as claimed in claim 1, wherein an outer thread section with smaller diameter is formed above the fitted section, an annular groove being formed above the outer thread section, in which a watertight ring is inlaid, at least one water outlet being formed on a circumference of upper end of the water-guiding member to communicate with the water conduit, a pushpin-like water-figuring head being assembled with a top of the water-guiding member, the sprinkling gun further comprising a sprinkling head having an inner thread section for screwing on the outer thread section of the water-guiding member.

10. A sprinkling gun structure comprising:

a main body, one end of the main body being formed with a water inlet, another end of the main body being formed with an adaptation hole having a fitting section, an assembling tunnel being transversely formed through the main body between the water inlet and the adaptation hole to communicate therewith, a controlling member having a water intake and at least one water-checking section being rotatably fitted in the assembling tunnel, the controlling member being rotationally drivingly engaged with an adjustment member, whereby by means of rotating the adjustment member by different angles, the water intake and the water-checking section are displaced to different extents so as to control the amount of the sprinkling water or turn off/on the water flow, the sprinkling gun structure further comprising a water-guiding member having a fitted section and fixedly fitted in the fitting section of the main body, the water-guiding member being formed with a water conduit, a soft watertight sleeve being fitted with a lower section of the water-guiding member, a concaved attaching face being formed at lower end of the watertight sleeve, a water-sealing section integrally swelling from the concaved attaching face for tightly abutting against the water-checking section of the controlling member to achieve a shutoff state, the soft watertight sleeve having a downward tapered section extending from the concaved attaching face for tightly abutting against inner wall face of the adaptation hole, when the water-checking section of the controlling member is rotated along with the adjustment member to disengage from the attaching face of the watertight sleeve, the water intake communicating with the water conduit and the water inlet to achieve a turn-on state, whereby the water can flow through the water inlet and the water intake into the water conduit and sprinkle out, wherein an outer thread section with smaller diameter is formed above the fitted section and wherein an annular groove is formed above the outer thread section, in which a watertight ring is inlaid, at least one water outlet being formed on a circumference of upper end of the water-guiding member to communicate with the water conduit, a pushpin-like water-figuring head being assembled with a top of the water-guiding member, and wherein the sprinkling gun structure further comprising a sprinkling head having an inner thread section for screwing on the outer thread section of the water-guiding member.

11. The sprinkling gun structure as claimed in claim 10, wherein the fitting section of the main body and the fitted section of the water-guiding member have larger diameter, whereby an annular stopper shoulder section is defined between the adaptation hole and the fitting section, several ribs being formed on inner wall face of the fitting section and several engaging notches being formed on outer circumference of the fitted section, the ribs being fixedly chucked and located in the engaging notches.

12. The sprinkling gun structure as claimed in claim 10, wherein engaging ribs are formed on outer face of lower section of the water-guiding member and recesses are formed on inner face of the soft watertight sleeve, the engaging ribs being chucked and located in the recesses.

13. The sprinkling gun structure as claimed in claim 10, wherein a water-sealing section is positioned on the tapered section of the watertight sleeve for tightly abutting against inner wall face of the adaptation hole.

14. The sprinkling gun structure as claimed in claim 10, wherein a first water-sealing section swells from the concaved attaching face of the watertight sleeve for tightly abutting against the water-checking section of the controlling member and a second water-sealing section is positioned on the tapered section of the watertight sleeve for tightly abutting against inner wall face of the adaptation hole of the main body.

15. The sprinkling gun structure as claimed in claim 10, wherein one end of the controlling member is formed with a fitting section having smaller diameter, a sealing cap being fitted with the fitting section, the fitting section being a tubular section formed with two symmetrical adaptation planes and two symmetrical hook-shaped resilient tongues, two adaptation planes and two windows being symmetrically disposed on an inner wall of the sealing cap and respectively adapted to the adaptation planes and resilient tongues of the fitting section, the end of the controlling member being formed with an annular groove in which a watertight ring is inlaid, the other end of the controlling member having a stopper section with larger diameter, projecting blocks being respectively formed on two sides of the stopper section, and whereby the other end of the controlling member serves as another fitting section, the adjustment member being a U-shaped member defining a holding space adapted to the main body, free ends of two arms of the adjustment member being respectively formed with two stop seats each defining a stepped fitting hole, two notches being symmetrically formed on two sides of each stop seat, the projecting blocks of the stopper section and projecting blocks of the sealing cap being chucked and located in the notches.

16. The sprinkling gun structure as claimed in claim 10, wherein the water intake is formed at a middle portion of the controlling member, the water-checking sections being an arced plate-like section symmetrically disposed on two sides of the water intake along a circumference thereof.

17. The sprinkling gun structure as claimed in claim 10, wherein the controlling member has a semicircular water intake and a semicircular water-checking section.

18. The sprinkling gun structure as claimed in claim 10, wherein a downward tapered section is formed on upper portion of the fitted section of the water-guiding member for tightly abutting against inner wall face of the fitting section of the main body, a punching force being applied to the end face of the fitting section to rivet the fitting section with the fitted section, whereby the water-guiding member is fixedly restricted within the fitting section.

* * * * *